United States Patent [19]

Bonenberger

[11] Patent Number: 4,693,527

[45] Date of Patent: Sep. 15, 1987

[54] ROLLING LOOP TWIST CAPSULE

[75] Inventor: Kenneth E. Bonenberger, Blacksburg, Va.

[73] Assignee: Litton Systems, Inc., Blacksburg, Va.

[21] Appl. No.: 856,247

[22] Filed: Apr. 28, 1986

[51] Int. Cl.[4] ..... H01R 39/02

[52] U.S. Cl. ..... 439/13

[58] Field of Search ..... 339/3-8, 339/2 L

[56] References Cited

U.S. PATENT DOCUMENTS

| | | | |
|---|---|---|---|
| 3,597,721 | 8/1971 | Mangan | 339/5 R |
| 3,599,165 | 8/1971 | Wendell et al. | 339/5 M |
| 4,607,898 | 8/1986 | Reighard et al. | 339/5 R X |

FOREIGN PATENT DOCUMENTS

| | | | |
|---|---|---|---|
| 903046 | 1/1945 | France | 339/2 L |

*Primary Examiner*—Eugene F. Desmond

*Attorney, Agent, or Firm*—Brian L. Ribando

[57] ABSTRACT

A twist capsule conducts signals between an input and an output which are rotatable relative to one another through one or more flat cables which are fixed to both the capsule rotor and the capsule stator. Each flat cable is folded over onto itself to form a rolling loop which propagates around the axis of the capsule in response to rotation of the rotor. The propagation of the rolling loops is equal to half the rotation of the rotor disk allowing capsule rotation of up to 175 degrees in either direction, or 350 total degrees.

10 Claims, 7 Drawing Figures

Fig_3
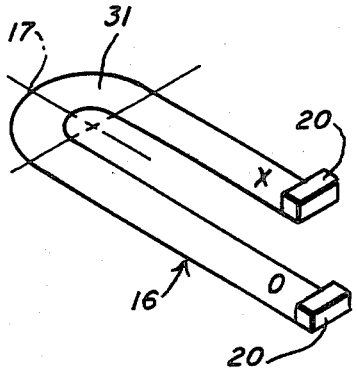
Fig_4
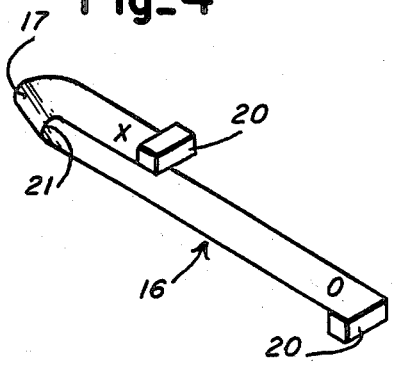
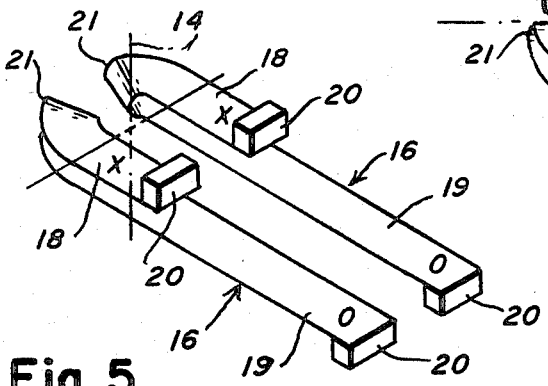
Fig_5
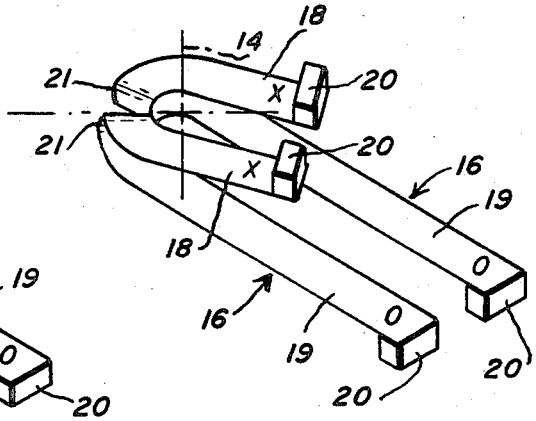
Fig_6
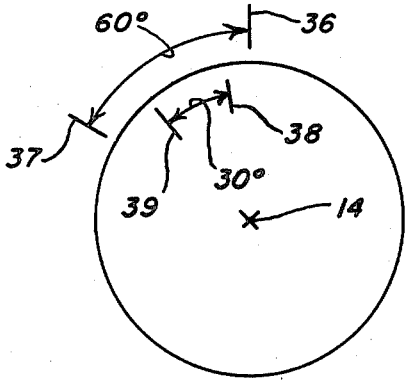
Fig_7

ROLLING LOOP TWIST CAPSULE

BACKGROUND OF THE INVENTION

This invention relates to a twist capsule which conducts signals between an input and an output which are rotatable relative to one another around an axis of the twist capsule.

Devices for conducting signals between two points which are rotatable relative to one another are well known in the art. Such devices or rotary joints comprise slip rings which are used when unlimited rotation is required, and twist capsules which are used when only limited rotation is required. The present invention relates to twist capsule in which only limited rotation of the capsule around its axis is required. Such a structure is shown in U.S. Pat. No. 3,599,165 issued to Wendell et al.

The Wendell et al patent shows a twist capsule in which a flat cable is wound in a spiral around the axis of the twist capsule. The inner and outer portions of the capsule are rotatable relative to one another in both clockwise and counterclockwise directions. Such rotation causes a coiling and uncoiling of the spirally wound flat cable around the capsule axis and around itself. Over a period of extended use, the coiling causes an abrasion of the cable insulation which can lead to capsule failure. Additionally, because one end of the flat cable is located in the center of the spiral, individual leads must be attached to the ends of the flat cable in order to connect the cable to external wiring. The attachment of the leads to the flat cable is time consuming and adds undesirable cost and complexity to the capsule assembly.

It would, accordingly, be desirable to construct a twist capsule without a spiral wrap to avoid the above mentioned drawbacks of internal abrasion and lead attachment.

SUMMARY AND OBJECTS OF THE INVENTION

According to the invention, a twist capsule comprises two disk shaped members having an axis of rotation which is perpendicular to the plane of the disks. One or more flat signal carriers may be utilized in the twist capsule according to the number of circuits required. Each flat signal carrier is folded over onto itself to produce a rolling loop between the two disk members in the region of the fold. Rotation of one disk relative to the other produces a propagation of the rolling loop around the axis of the twist capsule. The propagation of the rolling loop around the axis of the twist capsule is equal to one half of the rotation of the one disk relative to the other disk. Because of this, a twist capsule according to the invention can rotate up to 175° in either direction. Both ends of the flat signal carriers are accessible outside of the capsule housing.

It is, accordingly, an object of the invention to provide a twist capsule for use with flat signal carriers which does not use a spiral cable wrap.

It is another object of the invention to provide a twist capsule wheren flat signal carriers are folded upon themselves to create a rolling loop inside of the twist capsule.

It is a still further object of the invention to provide a twist capsule having an axis of rotation which is perpendicular to the plane of a flat signal carrier contained within.

These and other objects of the invention will become apparent from the following detailed description in which reference numerals used throughout the description correspond to reference numerals appearing on the drawing figures.

BRIEF DESCRIPTION OF THE DRAWINGS

FIG. 3 shows a flat signal carrier before being folded for use in the twist capsule of FIGS. 1 and 2.

FIG. 4 shows the signal carrier of FIG. 3 after being folded.

FIG. 5 is a perspective schematic view of two flat signal carriers as used in the twist capsule of FIGS. 1 and 2.

FIG. 6 shows the flat signal carriers of FIG. 5 after a counterclockwise rotation of the twist capsule.

FIG. 7 is a schematic view showing the relative rotation between the twist capsule and the rolling loop in the capsule.

DESCRIPTION OF THE PREFERRED EMBODIMENT

Figure 1:
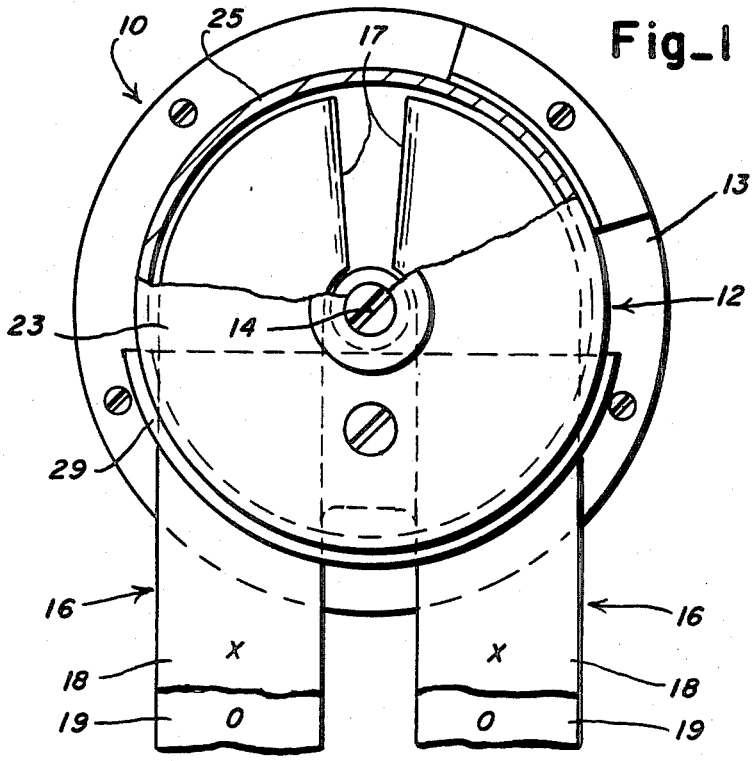
FIG. 1 is a top view of the twist capsule.
Figure 2:
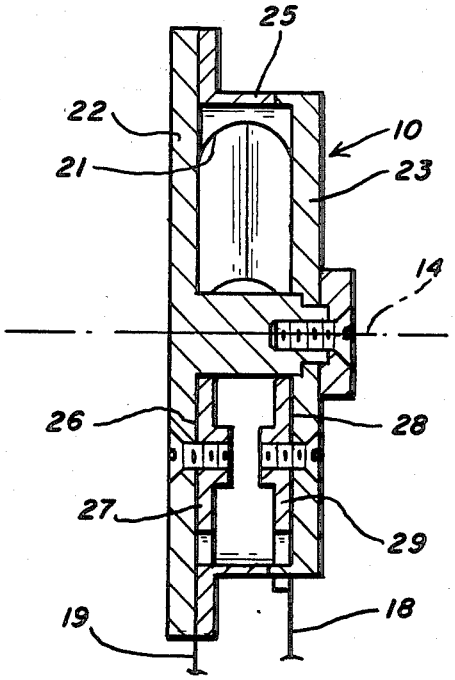
FIG. 2 is a side sectional view of the twist capsule of FIG. 1.

Turning now to the drawings, there is shown in FIGS. 1 and 2 a twist capsule generally designated by the reference numeral 10. The capsule comprises a housing 12 having a central axis 14 and a mounting flange 13. The housing 12 comprises a stator disk 22, a rotor disk 23, and a cylindrical sidewall 25. A pair of flat signal carriers 16 are positioned within the housing 12 on either side of the axis of rotation 14. Each flat carrier 16 is loosely folded over upon itself along a fold line 17. For purposes of reference only, each flat signal carrier 16 is shown having an "X" on the rotor end 18 and an "O" on the stator end 19. Both the rotor end 18 and the stator end 19 are accessible outside of the housing 12.

The fold of the flat signal carriers 16 forms a rolling loop 21 in the region of the fold line 17. The rolling loop 21 spans the distance between the stator disk 22 and the rotor disk 23 of the twist capsule and allows the rotor disk 23 to rotate around the axis 14 relative to the stator disk 22. A first portion 26 of each flat signal carrier 16 is fixed relative to the stator disk 22 by means of a stator clamp 27, and a second portion 28 of each signal carrier 16 is fixed relative to the rotor disk 23 by means of a rotor clamp 29.

Turning now to FIG. 3, a flat signal carrier 16 is shown before being folded along a fold line 17. As shown, the cable 16 includes an arcuate shaped portion 31 which is bisected by the fold line 17. FIG. 4 shows the cable 16 after folding and the formation of the rolling loop 21. The rolling loop itself describes an arc which measures 180°. Connectors 20 may be provided on the ends of the flat signal carriers 16 in order to facilitate connections made to external wiring.

Turning now to FIGS. 5 and 6, two flat signal carriers 16 formed according to the invention for use in a twist capsule are shown in schematic perspective view. FIG. 5 shows the twist capsule in a neutral or central position before rotational displacement of the rotor ends 18. As shown in FIG. 6, displacement of the rotor ends 18 in a counterclockwise direction around the axis of rotation 14 causes a counterclockwise displacement of each of the rolling loops 21 around the axis of rotation 14; and the arcuate shape of the portion 31 of each of the flat signal carriers 16 allows the rolling loop 21 to follow a circular path around the axis 14.

As shown in FIG. 7, a given angular displacement of the rotor ends 18 around the axis of rotation 14 causes an angular displacement of the rolling loops 21 which is half that of the rotor ends 18. As an example, if the rotor ends rotate 60° around the axis 14 from position 36 to position 37, the rolling loops 21 propagate only 30° around the axis 14 from position 38 to position 39. As a result, if in the neutral position the location of the rolling loops 21 is 180° from the position where the first portions 26 and the second portions 28 of the signal carriers are fixed to the stator and the rotor respectively, the rotor will be able to turn 360° in either direction from the neutral position before the rolling loop reaches the first or second end portions.

In practice, the stator clamps 28 and the rotor clamps 29 cover a segment of the signal carrier; and it is not possible to achieve full 360° rotation of the rotor in either direction. Accordingly, it has been found that maximum capsule rotation is limited to 175° in either direction or 350 total degrees.

Figure 8:
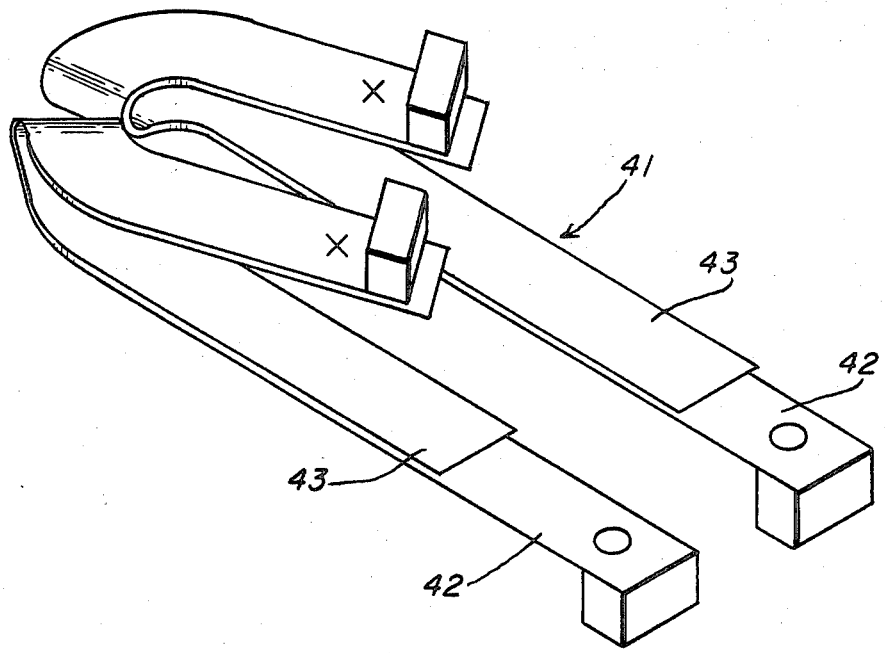
FIG. 8 is a perspective view of an alternate form of a twist capsule.

The twist capsule 10 may take forms other than those specifically described above. As an example, it is not necessary to have two flat signal carriers 16 in each capsule assembly; and accordingly, a twist capsule may be manufactured with only one flat signal carrier 16. Additionally, more than two flat signal carriers 16 may be utilized in a single twist capsule by overlapping the carriers one upon the other. FIG. 8 shows a twist capsule 41 in which a second pair of flat signal carriers 42 overlaps and is in substantial alignment with a first pair 43 of flat signal carriers. It will be understood by those skilled in the art that the flat signal carriers 16 may comprise a plurality of discrete signal paths arranged side by side across the width of the signal carrier; and as an example, the flat signal carriers 16 may comprise flexible printed circuit tapes.

Having thus described the invention, various alterations and modifications thereof will become apparent to those skilled in the art which modifications and alterations are intended to be within the scope of the invention as defined by the appended claims.

What is claimed is:

1. A twist capsule for conducting signals between an input and an output which are rotatable relative to one another, the twist capsule comprising:

a stator disk;

a rotor disk which is spaced from the stator disk;

an axis of rotation for the twist capsule which is perpendicular to both the stator disk and the rotor disk; and a flat signal carrier having a first portion which is fixed relative to the stator disk and a second portion which is fixed relative to the rotor disk, wherein the axis of rotation of the twist capsule is perpendicular to the plane of the first portion of the flat signal carrier and to the plane of the second portion of the flat signal carrier, and wherein said flat signal carrier is formed from a U-shaped flat signal carrier comprising an arcuate portion and two side-by-side straight portions extending therefrom, said U-shaped flat signal carrier being loosely folded in the region of the arcuate portion to form a rolling loop between said first portion and said second portion, the rolling loop allowing at least 350 degrees of rotation between the stator disk and the rotor disk.

2. The twist capsule of claim 1 wherein the rolling loop reverses the direction of the first flat signal carrier between the stator disk and the rotor disk.

3. The twist capsule of claim 2 wherein the rolling loop between the stator disk and the rotor disk describes an arc in the flat signal carrier which measures substantially 180 degrees.

4. The twist capsule of claim 3 wherein rotation of the rotor disk in a selected direction causes a propagation of the rolling loop around the axis of the twist capsule axis in the same direction.

5. A twist capsule for conducting signals between an input and an output which are rotatable relative to one another, the twist capsule comprising;

a stator disk;

a rotor disk which is spaced from the stator disk;

an axis of rotation for said twist capsule which is perpendicular to both the stator disk and the rotor disk; and a pair of flat signal carriers positioned on opposite sides of the axis of rotation, each of the flat signal carriers having a first portion which is fixed relative to the stator disk and a second portion which is fixed relative to the rotor disk, wherein each of the flat signal carriers is formed from a U-shaped flat signal carrier comprising an arcuate portion and two side-by-side straight portions extending therefrom, each of said U-shaped flat signal carriers being loosely folded in the region of the arcuate portion to form a rolling loop between said first portion and said second portion, whereby rotation of the twist capsule in one direction causes one loop to roll and the other loop to unroll, and whereby the rolling loops allow at least 350 degrees of rotation between the stator disk and the rotor disk.

6. The twist capsule of claim 5 wherein the rolling loops reverse the direction of the flat signal carriers between the stator disk and the rotor disk.

7. The twist capsule of claim 6 wherein each of the rolling loops between the stator disk and the rotor disk describe an arc which measures substantially 180 degrees.

8. The twist capsule of claim 7 wherein rotation of the rotor disk in a selected direction causes a propagation of the two rolling loops in the same direction.

9. The twist capsule of claim 8 further comprising:

a third flat signal carrier overlying and in substantial alignment with one of said pair of flat signal carriers.

10. The twist capsule of claim 8 further comprising:

a second pair of flat signal carriers, each one of the second flat signal carriers overlying and in substantial alignment with a respective one of the first pair of flat signal carriers.

* * * * *